United States Patent [19]

Rimmer et al.

[11] Patent Number: 4,559,674

[45] Date of Patent: Dec. 24, 1985

[54] MOVABLE FLAT FOR A CARDING ENGINE AND A SUPPORT ASSEMBLY THEREFOR

[76] Inventors: Michael J. Rimmer, 15 Heath Ave., Halifax, West Yorkshire; John M. J. Varga, Royd Lodge, 2 Lawrence Rd., Skircoat Green, Halifax, West Yorkshire, HX3 OLH, both of England

[21] Appl. No.: 607,770

[22] Filed: May 7, 1984

Related U.S. Application Data

[63] Continuation-in-part of Ser. No. 378,639, May 17, 1982, abandoned.

[30] Foreign Application Priority Data

May 16, 1981 [GB] United Kingdom ..... 8115076
Feb. 23, 1982 [GB] United Kingdom ..... 8205241

[51] Int. Cl.[4] ..... D01G 15/08
[52] U.S. Cl. ..... 19/102; 19/111
[58] Field of Search ..... 19/102, 103, 111, 113

[56] References Cited

U.S. PATENT DOCUMENTS 3,143,771 8/1964 Kluttz et al. ..... 19/102

FOREIGN PATENT DOCUMENTS 0006666 of 1892 United Kingdom ..... 19/103
0344220 3/1931 United Kingdom ..... 19/103

*Primary Examiner*—Louis K. Rimrodt
*Attorney, Agent, or Firm*—Henry Sternberg; Bert J. Lewen

[57] ABSTRACT

A movable flat assembly for a carding engine. Each of a plurality of flat bars is connected at each end thereof to a chain at the respective side of the carding engine. Each chain comprises a plurality of connected units, each having coupling means for connection to the next adjacent unit and a carrier detachably connected to the flat bar. A support wheel is rotatably mounted on the carrier and is in rolling engagement with the bend at the respective side of the carding engine. Each side wheel has an axis of rotation parallel to the longitudinal mid plane of the respective flat bar and spaced therefrom by a distance that is no less than half the width of the flat bar.

13 Claims, 8 Drawing Figures

FIG. 1
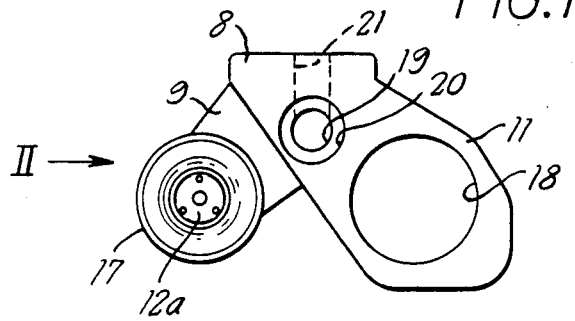
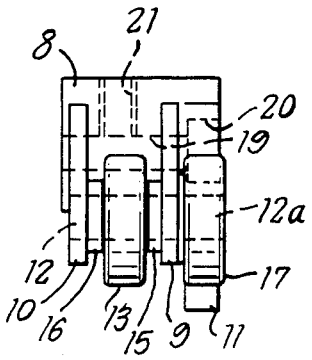
FIG. 2
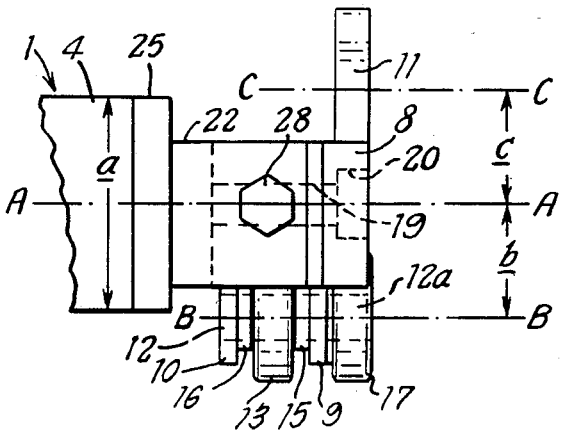
FIG. 3

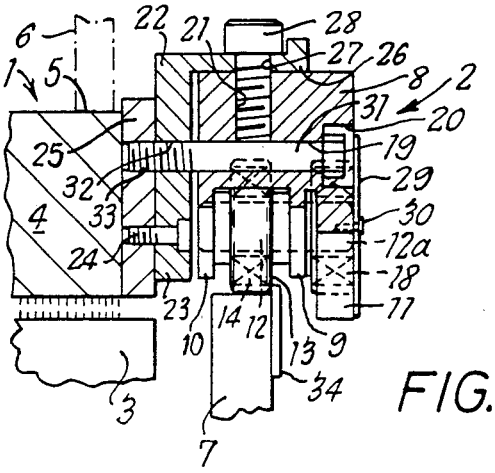
FIG. 4
FIG. 5
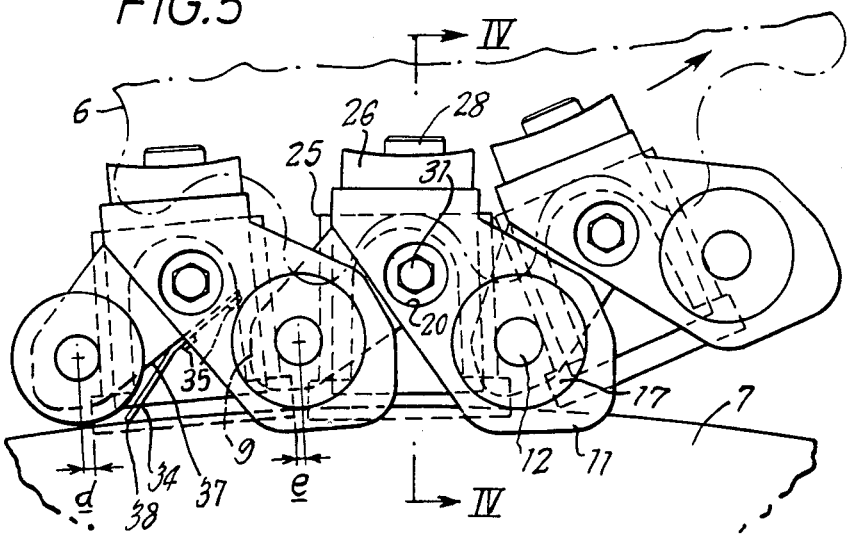
FIG. 6
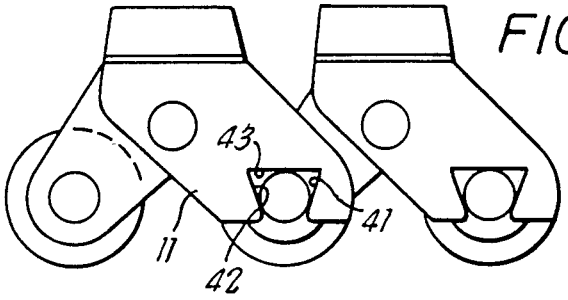

MOVABLE FLAT FOR A CARDING ENGINE AND A SUPPORT ASSEMBLY THEREFOR

This application is a continuation-in-part of application Ser. No. 378,639 filed May 17, 1982, now abandoned.

This invention relates to movable flats for carding engines and to support assemblies therefor.

It is generally accepted as being very desirable to have the movable flats spaced as closely as possible to the main cylinder of a carding engine, so that the spacing between the tips of the teeth on the flats and the tips of the teeth on the main cylinder is as small as possible. Using small settings, for example of seven thousandths of an inch or less it is possible either to increase quality of the carded web or to achieve significant increases in production rate for the same quality as was previously possible. Considerable problems must be overcome to achieve the close settings contemplated. One major problem arises from wear between the ends of the flats and the surfaces of the bends on which those ends are supported and on which the flats slide. Wear in this region can rapidly affect previously chosen settings, with consequent deleterious results on production, or even damage to the carding engine itself. The object of the present invention is to reduce the problems that may be caused by such wear.

According to the present invention a movable flat assembly for a carding engine comprises a chain at each side of the carding engine and a plurality of flat bars extending between the chains, in which each chain comprises a plurality of connected units, each unit comprising coupling means for connection to the next adjacent unit, a carrier, connecting means for detachably connecting one end of a flat bar to said carrier, a support wheel rotatably mounted on said carrier and having a circular periphery for engagement with a bend of said carding machine, said support wheel having an axis of rotation that is parallel to the longitudinal mid-plane of said flat bar, and said support wheel and said connecting means being so disposed that when a flat bar is connected to said unit said axis of rotation is parallel to said longitudinal mid-plane and the perpendicular distance between said axis of rotation and said longitudinal mid-plane is no less than half the width of said flat bar.

Also in accordance with the invention a movable flat for a carding engine comprises a flat bar and first and second end assemblies, one at each end of said flat bar, each said end assembly comprising a carrier, a support means rotatably mounted on said carrier and having a circular support surface for engagement with a bend of said carding machine, said support means having an axis of rotation that is parallel to the longitudinal mid-plane of said flat bar and that is spaced perpendicularly from said longitudinal mid-plane by a distance that is no less than half the width of said flat bar.

The seemingly simple improvement provided by the invention can prove to be of dramatic importance in achieving and maintaining close settings. The provisions of rotatable support for the ends of the flats substitute rolling friction for the sliding and rubbing friction now commonly experienced due to sliding engagement between the flat ends and the bends of the carding engine. Quite apart from reducing wear to almost zero levels it can also lead to a very significant reduction in the power required to drive the flats assembly, with consequent savings in that simpler, less powerful drives are required. Indeed, flat assemblies of the invention can readily be moved by hand in order rapidly to bring individual flat bars to a required location. Furthermore, as will become apparent, the spacing of the axis of rotation from the longitudinal mid-plane allows these advantages to be gained without the flat fouling the carding engine cylinder and allows each flat to stabilise very quickly into its working position after being brought into contact with the bend.

When the flat bars are detachably connected to the end assemblies, as is preferred, the connected assemblies form a chain at each side of the carding engine, which replaces the conventional chain arrangement used to couple together strings of flats. Replacement of individual flat bars may then readily be effected by simply disconnecting the ends of the flat bar from their respective carriers and substituting the new flat bar. Conveniently there may be provision for adjustment of the flat bar relative to the end assembly in order to facilitate the setting of the flat bar to achieve the required spacing between the carding elements on the flat bar and those on the main carding cylinder.

In order that the invention may be better understood, preferred embodiments of flats made in accordance therewith will now be described in more detail, by way of example only, with reference to the accompanying drawings, in which:

FIG. 1 is an end elevation of a first embodiment of flat end assembly;

FIG. 2 is an end elevation of the assembly of FIG. 1 in the direction of the arrow II;

FIG. 3 is a top plan view of the assembly of FIG. 1 attached to a flat;

FIG. 4 is a cross section on the line IV—IV of FIG. 5 showing an end assembly on a flat in position on a carding engine;

FIG. 5 is a side elevation of part of a carding engine having flats assembled thereon;

FIG. 6 is an end elevation showing a second embodiment of flat and end assembly.

Figure 7:
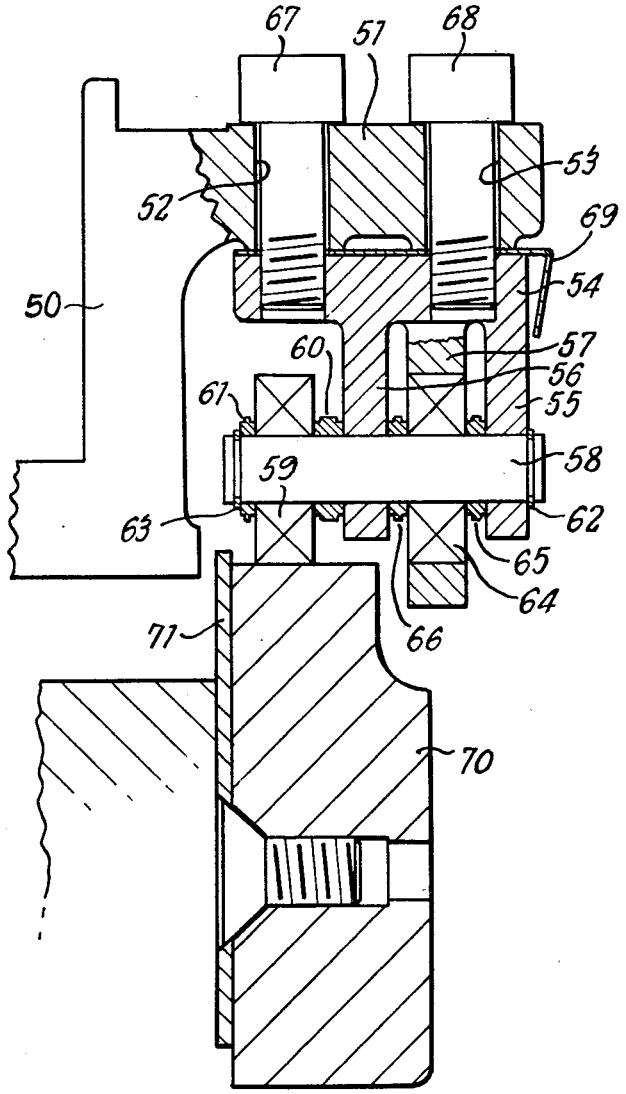
FIGS. 7 and 8 are views similar to FIG. 4 of two further embodiments of flat assembly.

Referring first to FIGS. 3 and 4 there is shown a flat 1 having an end assembly 2. A plurality of such flats and assemblies form a string of flats which are driven in conventional manner to move over the appropriate arc of the main cylinder 3 of a carding machine. Each flat is of identical construction and comprises a flat bar 4 having a longitudinal mid-plane A—A and extending across the full width of the carding cylinder. The flat bar is provided with card clothing or other carding elements on the surface that faces towards the card clothed surface of the cylinder. Each flat bar has a section 5 that is engageable by the conventional nug wheel 6 in order to drive the flats in their endless path over the surface, around the nug wheel, along the return section of the path above that surface and around a block wheel to come once again face to face with the carding cylinder. While passing over the surface, the assembly 2 is supported on the respective bend 7 of the carding engine. Each end of each flat bar has an end assembly 2, the assemblies at each end of each flat being identical except for being of opposite hand, and only one such end assembly will therefore be described.

Each end assembly comprises a body 8 from which depend two side plates 9 and 10 and a coupling plate 11. The body and plates may be formed as an integral unit, desirably by investment casting, although the body may alternatively be made up from individual sections welded or otherwise secured together as appropriate. Extending through aligned holes in the two side plates 9 and 10 is a spindle 12 supporting a suitable bearing, desirably a non-lubricating ball bearing, the outer race of which forms a wheel 13. Washers 15 and 16 are used to centre the wheel between the side plates 9 and 10. The spindle 12 is rendered axially captive relative to the side plates in any convenient manner, for example by appropriately located circlips engaging grooves in the spindle. The spindle 12 has an end section 12*a* that extends axially beyond the outer side plate 9 and pivot bearing 17 is rotatably mounted on this end section. The external diameter of the pivot bearing 17 is such that it may be received as a close fit within a circular hole 18 formed within the coupling plate 11.

The axis of rotation B—B of the wheel 13, and the axis C—C of the bearing 17 and hole 18 in the coupling plate 11 lie to opposite sides of the longitudinal mid-plane A—A of the flat bar and in a common plane perpendicular to said mid-plane. The spacings b, c respectively of each axis B—B, C—C from the mid-plane A—A perpendicular to that plane are equal, and in each case the spacing is greater than half the width a of the flat bar.

The body 8 is formed with a through bore 19, the axis of which extends parallel to the axis of the spindle 12, the bore 19 having an enlarged counterbore end 20 at the axially outer end of the bore. The body is also formed with a bore 21 extending at right angles from the upper surface of the body to intersect the bore 19.

FIGS. 3 to 5 show an assembly of flat bars 4 and their end assemblies 2 on a carding engine. Each flat bar has secured at each end thereof an end member 22 in the form of an inverted L having a side plate 23 secured by a countersunk bolt 24 to an end member 25 of the flat bar and having a top plate 26 with an opening 27 through which a bolt 28 may be passed.

At each side of the card a plurality of assemblies 2 are formed into a chain-like structure on the bend by engaging the opening 18 in the coupling means 11 around the pivot bearing 17 of the next adjacent flat. When so assembled the coupling means 11 is prevented from sliding axially off the pivot bearing 17 by securing retaining means to the assembly carrying the pivot wheels, the retaining means overlying part of the other assembly to restrain relative axial movement between the two assemblies. The retaining means may take any one of a number of forms; in the example shown the retaining means is a retaining plate 29 of larger diameter than the opening 18, the plate being secured by a self-tapping screw 30 to the end section 12*a* of the spindle 12. After assembly of the chain onto the carding engine, flat bars with their end pieces 22 are then mounted to extend across the cylinder between support assemblies 2 at each end of the flat bar. To secure a support assembly and flat bar together a bolt 31 is passed through the bore 19 in the body, the head of the bolt being received in the counter-bore 20. The bolt 31 passes also through a hole 32 in the side plate 23 and into a tapped bore 33 in the ends 25 of the flat bar. In addition, the bolt 28 is passed through the hole 27 and is screwed into the tapped bore 21 in the body 8 to engage the bolt 31 and so lock the parts securely together. In alternative arrangements flat bars may be assembled with and adjusted relative to, their end assemblies off the carding engine, and the chain of flats connected in situ on the carding engine.

Thus, once all the flat bars have been secured to associated support assemblies, the chain couples the flats together by the engagement of the coupling plates at each end of one flat with the spindle ends 12*a* of the support assembly of the next succeeding flat as is most clearly seen from FIG. 5. The wheels 13 of the flat support assemblies run on the bearing surfaces of the bends such as 7 of the carding engine and are prevented from moving axially off the bends by keeper sections 34 on the bends. The flats travel around the bends with only rolling friction, rather than the previously encountered sliding friction between the flat end and the bend. Thus, the setting of the end assembly 2 relative to the fixed end 25 of the flat will be maintained, and this setting determines the spacing between the tips of the flat wires and the tips of the wires on the main carding cylinder. FIG. 4 shows part of a chain of flat support assemblies in the region where the flats pass around the nug wheel 6 to start their return passage over the top of the card, the wheels 13 accordingly being lifted out of contact with the bend 7. In their return run the flats may be supported by conventional block shafts or by any other convenient means. At the end of their return path the flats pass around a block wheel at which point the wheels 13 again move into contact with the bends in order to support the flats during their run along the arc where they cooperate with the carding cylinder.

It should particularly be noted that when the flats are assembled each flat is supported at each end by two wheels, its own wheel and the wheel of the next adjacent flat. The spacing of the axes of rotation B—B, C—C of the two wheels from the plane A—A, ensures that each axis lies outside the span of the flat bar 4. Thus, as shown in FIG. 5 the axis 12 of the wheel 13 is spaced ahead of the flat bar 4 by a distance d and the axis 12*a* of the following wheel 17 is spaced behind the flat bar 4 by a distance e. This relationship ensures that if any flat is caused to lift for any reason lifting will be by pivoting about one of the wheel axes and that pivoting movement will ensure that the whole of the toothed surface of the flat is lifted away from the toothed cylinder surface. Thus, there is no danger of these two surfaces fouling and so causing substantial damage.

This arrangement also allows the block wheel to be set significantly closer to the bend than was hitherto possible, causing the flat supports to be seated more rapidly and more precisely on the bends than before, and without the danger of flats jamming between the bends and the nug wheels. This can substantially enhance carding efficiency, as it is well recognised that the majority of the carding effect is due to the first few flats encountered by the fibres.

The bends should desirably be kept clear of debris, which may otherwise accummulate and adversely affect the settings and operation of the carding engine. This may conveniently be done by equipping one or more of the flat support assemblies on each bend with a cleaning blade 38 as shown in FIG. 5. Such a blade may conveniently be secured by self-tapping screws 35 to face 37 of the assembly, the blade having an edge that will run in contact with the bend and so clean the bend. Alternative cleaning elements and methods of attachment could be employed.

From the mode of assembly that has been described it will be appreciated that it is a very simple matter to replace one or more flats as necessary. Individual flats can simply be removed from the chain by removal of bolts 28 and 31, to be replaced as desired. Such replacement may be necessary, for example, when the clothing on a flat becomes worn or when it is desired to re-equip the carding engine with flats having a different type of card clothing, for example teeth that will operate at different settings from the card clothing on the carding cylinder. Such replacement can be effected while the flats are in position on the bends, but it is equally straight-forward and perhaps desirable to effect replacement while the flats are in position on their return travel path. To facilitate replacement in this region the carding engine may incorporate below an appropriate section of the return path a tray into which removed flats may drop after removal of bolts 28 and 29 and from which they may then be removed.

As described, with the bolt 31 fitting closely through the body 8, the support assembly 2 is not adjustable to the remainder of the flat. If such adjustability is desirable, as will usually be the case, then the bore 19 will be made oversize relative to the bolt 31 or will be in the form of a slot elongated in the vertical direction. To effect adjustment of the support assembly both bolts 28 and 32 can be slackened and shims as appropriate can be inserted between the upper surface of the body 8 and the lower surface of the section 26. After insertion of the shims the bolt 28 is tightened and the bolt 32 is then tightened. It will be realised that the shim arrangement, or the relative alignment of the faces between which the shims are inserted may be such as to achieve a uniform setting of the flat or a "heel and toe" setting wherein the spacing between the flat wires and the cylinder wires at the leading edge of the flat is greater than that at the trailing edge of the flat. Alternatively, a heel and toe setting may be achieved with a uniform shim thickness by appropriate machining of faces on the flat and/or support.

FIG. 6 shows an alternative embodiment of the invention similar in many respects to that shown in the preceding Figures, but differing therefrom in the construction of coupling plate 11. As shown in FIG. 6 the coupling plate does not have an opening engaging around a second wheel, but it is instead formed with a broached end defining a wedge-like space 41 within which the spindle end 42 of the next adjacent flat is received. The taper is such that the spindle 42 is always forced hard against the surface 43 of the coupling plate and flat settings are made with this in mind.

In a further alternative a coupling element of one flat end assembly may be pivotally connected to the spindle of the next adjacent assembly by a hardened bush between the two elements or by suitable hardening or choice of materials for an opening in the coupling element and a spindle fitting into that opening.

Figure 8:
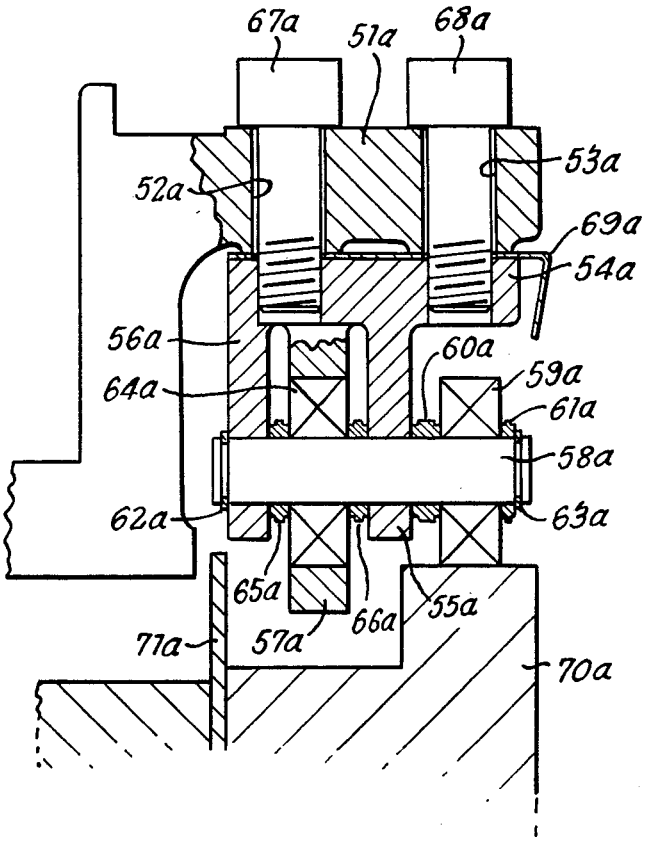

FIGS. 7 and 8 show two further embodiments of flat assembly. In the embodiment of FIG. 7 each flat bar 50 has an integral end section 51 formed with two vertical bores 52, 53. At each end of each flat bar there is an end unit comprising a body 54, two axially spaced arms 55, 56 extending to one side of the body and a coupling arm 57 extending to the other side in generally similar manner to the shown in FIG. 1. The arms 55, 56 support a spindle 58 which carries a wheel 59; washers 60, 61 and circlips 62, 63 locating the spindle and wheel in position. The coupling arm 57 has an opening in which is mounted a pivot bearing 64, capable of being engaged on the spindle 58 of the next adjacent unit, washers 65, 66 being used between the bearing 64 and arms 55, 56.

The flat bar is secured to the end unit by bolts 67, 68 passing through the bores 52, 53 and engaging tapped bores in the body 54. A shim 69 of appropriate thickness is located between the end section 51 and body 54. The wheel 59 of each unit engages end rolls on the bend 70 of the carding machine. A keeper plate 71 is secured to the bend to stand above the lowermost level of the flat bar and thus limit relative axial movement within the unit. A similar keeper plate on the bend at the opposite side of the carding engine similarly limits axial movement in the opposite direction.

The embodiment shown in FIG. 8 is similar to that of FIG. 7 and corresponding parts are given the same reference numeral with the suffix a. In this embodiment the wheel **59*a* lies axially outwardly of the pivot bearing 64*a* and the bend 70*a* is shaped to provide support for the wheels 59*a* accordingly. This arrangement has the advantage that the wheels 59*a* and bearing surface 70*a* are more accessible for cleaning. If required, a wheel 59*a*** may be removed and replaced without having to disturb any other component of the assembly.

We claim:

1. A movable flat assembly for a carding engine, the assembly comprising a chain at each side of the carding engine and a plurality of flat bars extending between the chains, in which each chain comprises a plurality of connected units, each unit comprising coupling means for connection to the next adjacent unit, a carrier, connecting means for detachably connecting one end of a flat bar to said carrier, a support wheel rotatably mounted on said carrier and having a circular periphery for engagement with a bend of said carding machine, said support wheel having an axis of rotation that is parallel to the longitudinal mid-plane of said flat bar, and said support wheel and said connecting means being so disposed that when a flat bar is connected to said unit said axis of rotation is parallel to said longitudinal mid-plane and the perpendicular distance between said axis of rotation and said longitudinal mid-plane is no less than half the width of said flat bar.

2. An assembly according to claim 1 in which said coupling means and said support wheel lie on opposite sides of said longitudinal mid-plane, and said coupling means includes pivot means connectable to said next adjacent unit to allow relative pivotal movement between said unit and said next adjacent unit, the pivot axis of said pivot means being parallel to said axis of rotation of said support wheel and being perpendicularly spaced from said longitudinal mid-plane by a distance no less than half the width of said flat bar.

3. An assembly according to claim 2 in which said pivot axis is coaxial with said axis of rotation of said support wheel of said next adjacent unit.

4. An assembly according to claim 3 in which said coupling means comprises a coupling arm and a bearing supported by said coupling arm and forming said pivot means, said bearing being capable of receiving a spindle rotatably carrying said support wheel of said next adjacent unit.

5. A movable flat for a carding engine, said flat comprising a flat bar and first and second end assemblies one at each end of said flat bar, each said end assembly comprising a carrier, a support means rotatably mounted on said carrier and having a circular support surface for engagement with a bend of said carding machine, said support means having an axis of rotation that is parallel to the longitudinal mid-plane of said flat bar and that is spaced perpendicularly from said longitudinal mid-plane by a distance that is no less than half the width of said flat bar.

6. A flat according to claim 5 in which said support means is a single wheel rotatably mounted on said carrier.

7. A flat according to claim 5 in which each said end assembly includes coupling means by way of which said flat may be coupled to an adjacent flat.

8. A flat according to claim 7 in which said coupling means includes a coupling arm, said coupling arm and said carrier extending to opposite sides of said longitudinal mid-plane of said flat bar.

9. A flat according to claim 8 in which said coupling arm carries pivot means whereby it can be engaged with an adjacent flat so as to allow relative pivoting therebetween about a pivot axis parallel to said longitudinal mid-plane and that is spaced perpendicularly from said plane by a distance that is no less than half the width of said flat bar.

10. A flat according to claim 9 in which said pivot axis and said axis of rotation lie in a common plane perpendicular to said longitudinal mid-plane and are spaced equidistantly to opposite sides of said lontitudinal mid-plane.

11. A flat according to claim 10 in which said pivot means comprises a bearing that is coaxial with said axis of rotation of said support means of said adjacent flat.

12. A flat according to claim 5 in which said support assembly is removably secured to said flat bar.

13. A flat according to claim 12 in which said support assembly is adjustable relative to said flat bar.

* * * * *